US010626872B2

(12) United States Patent
Vinther Toft

(10) Patent No.: US 10,626,872 B2
(45) Date of Patent: Apr. 21, 2020

(54) WATER SUPPLY SYSTEM

(71) Applicant: GRUNDFOS HOLDING A/S, Bjerringbro (DK)

(72) Inventor: Bjarne Vinther Toft, Randers SV (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 139 days.

(21) Appl. No.: 15/292,535

(22) Filed: Oct. 13, 2016

(65) Prior Publication Data

US 2017/0107986 A1 Apr. 20, 2017

(30) Foreign Application Priority Data

Oct. 15, 2015 (EP) ..... 15189911

(51) Int. Cl.

| | |
|---|---|
| ***F04D 13/06*** | (2006.01) |
| ***F04D 29/42*** | (2006.01) |
| ***F04D 29/62*** | (2006.01) |
| ***F04D 17/08*** | (2006.01) |
| ***F04D 29/02*** | (2006.01) |

(52) U.S. Cl.

CPC ..... *F04D 13/0686* (2013.01); *F04D 17/08* (2013.01); *F04D 29/4273* (2013.01);

(Continued)

(58) Field of Classification Search

CPC .. F04D 13/0686; F04D 17/08; F04D 29/4273; F04D 29/628; F04D 13/16;

(Continued)

(56) References Cited

U.S. PATENT DOCUMENTS 4,165,951 A * 8/1979 Friedman ..... E03B 5/00 137/489
5,017,104 A * 5/1991 Baker ..... F04D 29/044 384/252

(Continued)

FOREIGN PATENT DOCUMENTS

EP 0 663 553 A1 7/1995
EP 0663553 A1 * 7/1995 ..... E03B 5/02

(Continued)

OTHER PUBLICATIONS amazon.com/Goulds-JL07NKIT-Repair-Rebuild-JL07N/dp/B01AC60MRM showing the internal makeup of a centrifugal pump, rebuild kit screenshot (Year: 2019).*

(Continued)

*Primary Examiner* — Patrick Hamo
*Assistant Examiner* — David N Brandt
(74) *Attorney, Agent, or Firm* — McGlew and Tuttle, P.C.

(57) ABSTRACT

A water supply system includes a water inlet connection (12), a water outlet connection (28), a centrifugal pump (3), an electric motor (5), an electrical/electronic control and a diaphragm tank (30). The centrifugal pump (3) and the diaphragm tank (30) are arranged above one another and are connected to one another via a construction unit (6). The construction unit (6) includes the water connections (12, 28), the conduit connections between the water connections (12, 28) and the pump (3), as well as a threaded connection piece (29) for the diaphragm tank (30).

20 Claims, 6 Drawing Sheets

(52) U.S. Cl.
CPC ..... *F04D 29/4293* (2013.01); *F04D 29/628* (2013.01); *F04D 13/06* (2013.01); *F04D 29/026* (2013.01); *F05D 2250/52* (2013.01); *F05D 2300/43* (2013.01)

(58) Field of Classification Search
CPC .... F04D 29/4293; F04D 29/026; F04D 13/06; H05K 999/99; F05D 2300/43; F05D 2250/52
See application file for complete search history.

(56) References Cited

U.S. PATENT DOCUMENTS

| | | | | |
|---|---|---|---|---|
| 5,201,468 | A * | 4/1993 | Freier | B05B 1/1654 239/383 |
| 2005/0155782 | A1* | 7/2005 | Westberry | H01R 4/66 174/51 |
| 2014/0241921 | A1* | 8/2014 | Tazioli | F04D 29/426 417/423.14 |
| 2016/0084253 | A1* | 3/2016 | Vinther Toft | F04D 1/063 415/145 |

FOREIGN PATENT DOCUMENTS

| | | | |
|---|---|---|---|
| EP | 0 992 687 | A2 | 4/2000 |
| EP | 1217217 | A1 | 6/2002 |
| EP | 1 528 330 | A1 | 5/2005 |
| EP | 2 770 213 | A1 | 8/2014 |
| JP | H 10205484 | A | 8/1998 |
| RU | 76401 | U1 | 9/2008 |

OTHER PUBLICATIONS

Amtrol brochure for the Well-X-trol Accumulator (Year: 2019).*

* cited by examiner

WATER SUPPLY SYSTEM

CROSS REFERENCE TO RELATED APPLICATIONS

This application claims the benefit of priority under 35 U.S.C. § 119 of European Application 15 189 911.9 filed Oct. 15, 2015, the entire contents of which are incorporated herein by reference.

FIELD OF THE INVENTION

The invention relates to a water supply system with a water inlet connection, with a water outlet connection, with a centrifugal pump, with an electric motor driving the centrifugal pump, with a diaphragm tank and with an electrical/electronic control.

BACKGROUND OF THE INVENTION

Such water supply systems are counted as belonging to the state of the art and are applied in varied manners. A known water supply system of this type is marketed by the applicant under the description Grundfos MQ. This water supply system comprises a housing which essentially provides for the arrangement of an electric motor with a multistage centrifugal pump which is arranged thereafter and which is with a horizontal, i.e. lying drive axis. The housing which otherwise consists of plastic, in the region of the centrifugal pump is lined with a stainless steel pot which at the face side comprises a water inlet connection. A cuboid housing part is saddled onto the barrel-like housing at the motor side and this housing part houses a diaphragm tank as well as the electric/electronic control and the electrical connection. The outlet connection is arranged between this housing part and the pot-like stainless steel housing.

Although this water supply system has proven its worth, however it is also costly in manufacture and assembly due to its complicated design.

SUMMARY OF THE INVENTION

Against this background, it is an object of the invention according to the application, to improve a water supply system of the known type, with regard to a design and configuration thereof, in particular concerning the aspects of manufacturing costs, but also the handling.

The water supply system according to the invention comprises a water inlet connection, a water outlet connection, a centrifugal pump, an electric motor driving this, as well as electrical/electronic control and a diaphragm tank. According to the invention, the centrifugal pump and the diaphragm tank are arranged above one another and are connected to one another via a construction unit which comprises the water connections, the conduit connections between the water connections and the pump, as well as a connection for the diaphragm tank.

A basic concept of the design according to the invention is to spatially concentrate the parts of the water supply system which lead the fluid, and to lead them largely in a construction unit. An essential design precondition for this is that the centrifugal pump and the pressure tank are arranged over one another and are connected to one another via this construction unit comprising water connections, the conduit connections between the water connections and the pump, as well as a connection for the diaphragm tank. The construction unit according to the invention thus unifies all fluid connections of the water supply system, and specifically the external ones as well as the internal ones. This has advantages with regard to the design, since the remaining components which do not lead fluid, with regard to the material as well as the design can be fashioned without them having to fulfil the preconditions demanded for leading fluid. A further design advantage but also handling advantage is to be seen in the fact that all external water connections are provided on this one construction unit.

According to an advantageous further development of the invention, the construction unit not only comprises the previously mentioned leading of the conduits and connections, but also forms part of the pump casing, in particular comprises the suction port of the pump. Thus within the water supply system it is yet only the component surrounding the pump which is yet to be designed according to the demands for leading fluid.

According to an advantageous further development of the invention, the construction unit not only comprises the conduit connections and the previously mentioned conduit connecting, but moreover also a water discharge opening, via which the fluid located in the water supply system can be discharged to such an extent that the water supply system is protected from frost, without an antifreeze having to be filled.

With regard to manufacturing technology, it is particularly favorable if the mentioned construction unit is configured as a single-piece plastic injection molded part. The number of components can be reduced by way of this, by which means the storage maintenance costs and the assembly costs are reduced.

With water supply systems, it is counted as belonging to the state of the art, to design these such that the self-priming which is typically not given with centrifugal pumps is ensured after a first filling with water. According to a further envelopment of the invention, one envisages the means for self-priming, i.e. the means which are necessary for producing this self-priming effect, being arranged in the construction unit. Hereby, it is typically the case of a check vale and an opening with a closure plug, via which opening the filling can be effected.

The construction unit advantageously also comprises such a check valve which is advantageously arranged in a conduit section between the pump casing part and the water outlet connection and/or the connection for the diaphragm tank. Thereby, this conduit section for receiving the check valve is advantageously arranged such that it connects radially to the pump casing and is configured open at the end side. This arrangement on the one hand permits a compact construction manner and on the other hand permits an integration into this construction unit.

Thereby, according to one advantageous further development of the invention, the check valve is configured as an insertion cartridge, wherein the valve seat of the check valve is arranged in the construction unit, preferably in the conduit section which receives the check valve. The cartridge-like arrangement on the one hand permits the sealing body or at least the seal of the check valve to be exchanged in a simple manner by way of withdrawing the cartridge, and on the other hand the opening in the construction unit, via which the cartridge can be inserted or withdrawn, can be used as a filling opening for water. This is to be filled in for enabling the self-priming effect. This opening in any case needs to be sealingly closed by way of a closure, usefully by way of a closure plug which is suitably formed on the insertion cartridge.

With regard to the handling, it is particularly advantageous if the water connections are arranged at one side of the water supply system, and specifically to a side in the direction of the centrifugal pump axis. This is to be understood in that the water connections are arranged in the direction of the centrifugal pump axis or parallel thereto, this with a lying axis typically on a face wall which is arranged roughly vertically in operation and which is aligned perpendicularly to this axis.

It is advantageous if the water connections are formed by threaded connection pieces, on which in each case a connection piece component is limitedly movable, in particular pivotably and releasably fastened. Such an arrangement is advantageous, in order to compensate alignment errors when connecting to fixed conduits. The connection piece components can moreover be exchanged in a simple manner, in order to be able to be installed with the locally present connection components. Particularities specific to different countries can be taken into consideration without a large technical effort here, since the construction unit as such is not affected by this here.

It is particularly advantageous if the construction unit also comprises the connection for the diaphragm tank. This is advantageously formed by a threaded connection piece, wherein construction unit further comprises support means for the fastening and/or supporting the container.

A pressure sensor which is advantageously provided for pressure detection is advantageously integrated on the construction unit at the delivery/pressure side, via a connection piece.

An earth (ground) connection which is accessible from the outside and which according to an advantageous further development of the invention is arranged in the construction unit such that it is electrically in contact with the delivery fluid is provided in order to ensure the electrical safety of the water supply system. By way of this, it is ensured that components conducting or leading water are all earthed (grounded).

The pump casing on the construction unit side comprises the suction port as well as a flange, via which it can be screw-fastened to a tubular pump casing part which connects thereto. The pump casing can therefore advantageously likewise be attached on the construction unit which therefore with regard to the design also forms the carrying or supporting part of the components leading fluid. The further casing components terminating the water supply system itself can thus largely be fashioned freely and, if at all, only require a reduced supporting function.

The centrifugal pump and electric motor advantageously have a common shaft which is advantageously arranged in a lying manner, i.e. is arranged horizontally on operation. An inner housing is provided for the electronic control, and this inner housing is arranged above the motor, preferably next to the diaphragm tank. All live component of the pump (leading current) are arranged in the rear casing part, thus far from the components leading fluid with this arrangement, and this is advantageous.

The invention is hereinafter described in more detail by way of one embodiment example which is represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
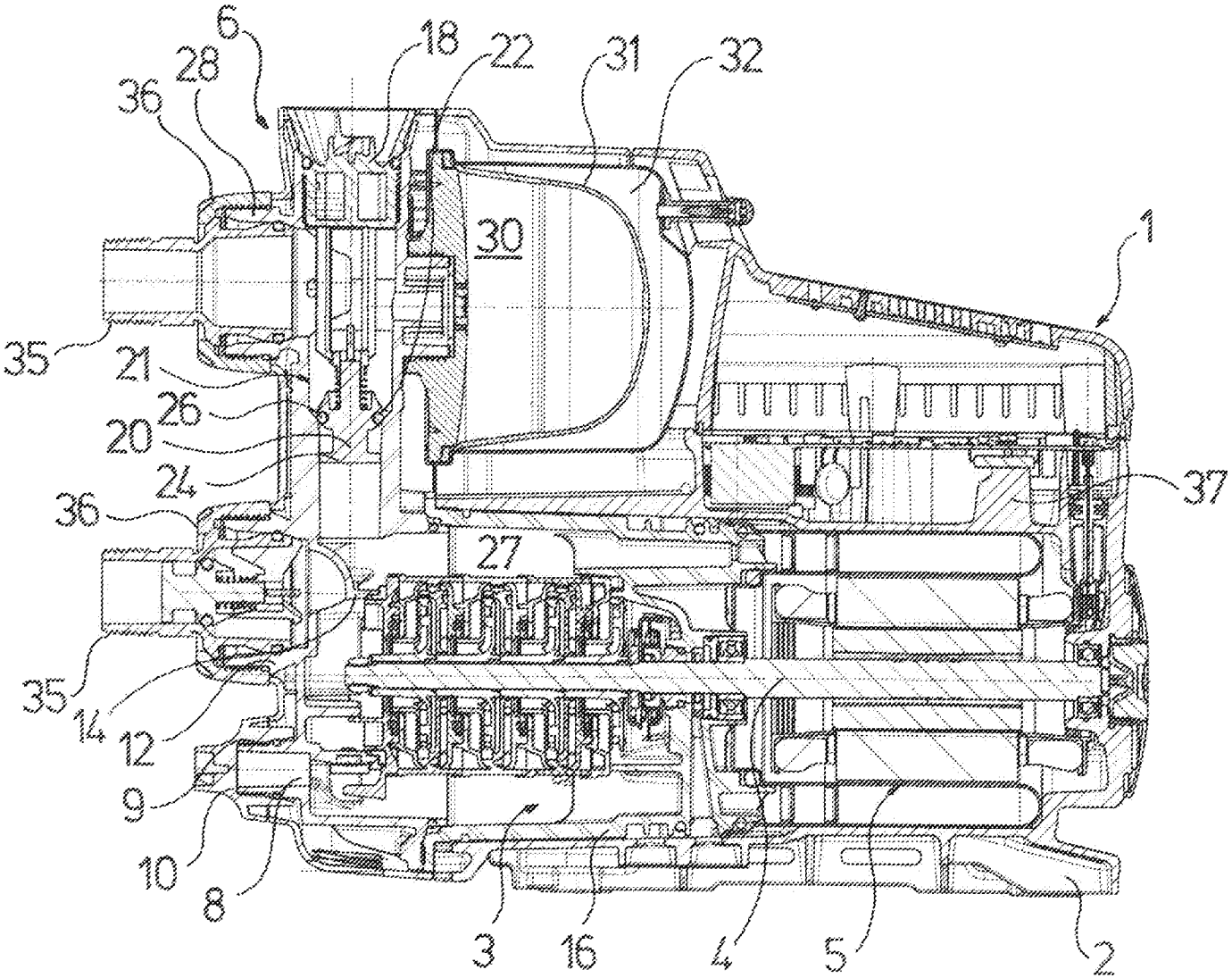
FIG. 1 is a greatly simplified, longitudinal sectional representation through a water supply system according to the invention.

Referring to the drawings, the water supply system has a construction that is evident from FIG. 1. The water supply system comprises a casing 1 which encloses the complete water supply system and which towards the bottom merges into a foot 2, with which the water supply system stands on a base surface and is typically anchored with screws. A multi-stage centrifugal pump 3 has a shaft 4 that carries impellers and reaches up to the electric motor 5 that drives the pump 3 and is arranged within the casing 1. The shaft 4 is arranged in a lying manner, i.e. the longitudinal axis of the drive lies horizontally and parallel to the placement surface of the foot 2.

Figure 3:
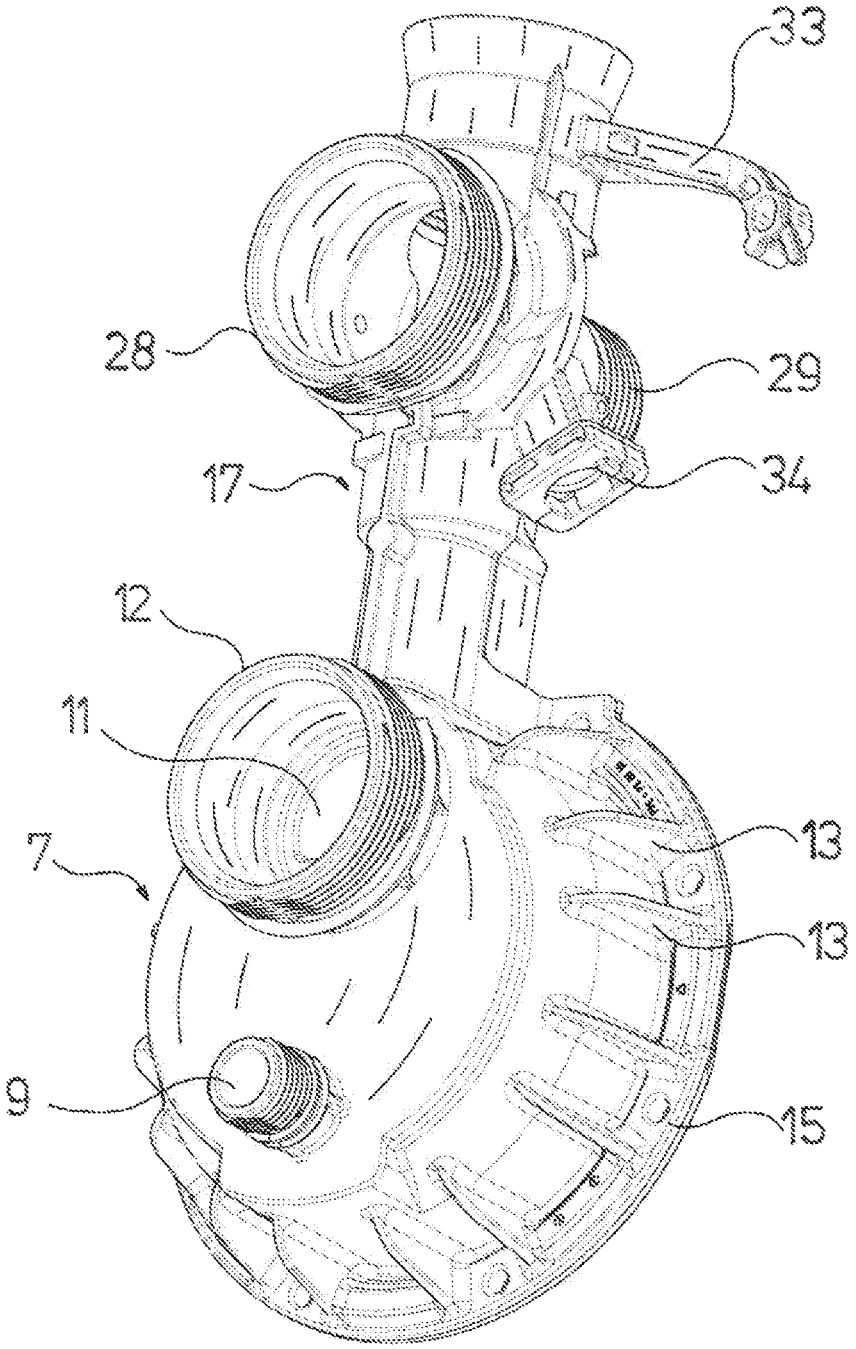
FIG. 3 is an enlarged perspective view of the construction unit with the side of the water connections, shown obliquely from below and the right at the front.
Figure 4:
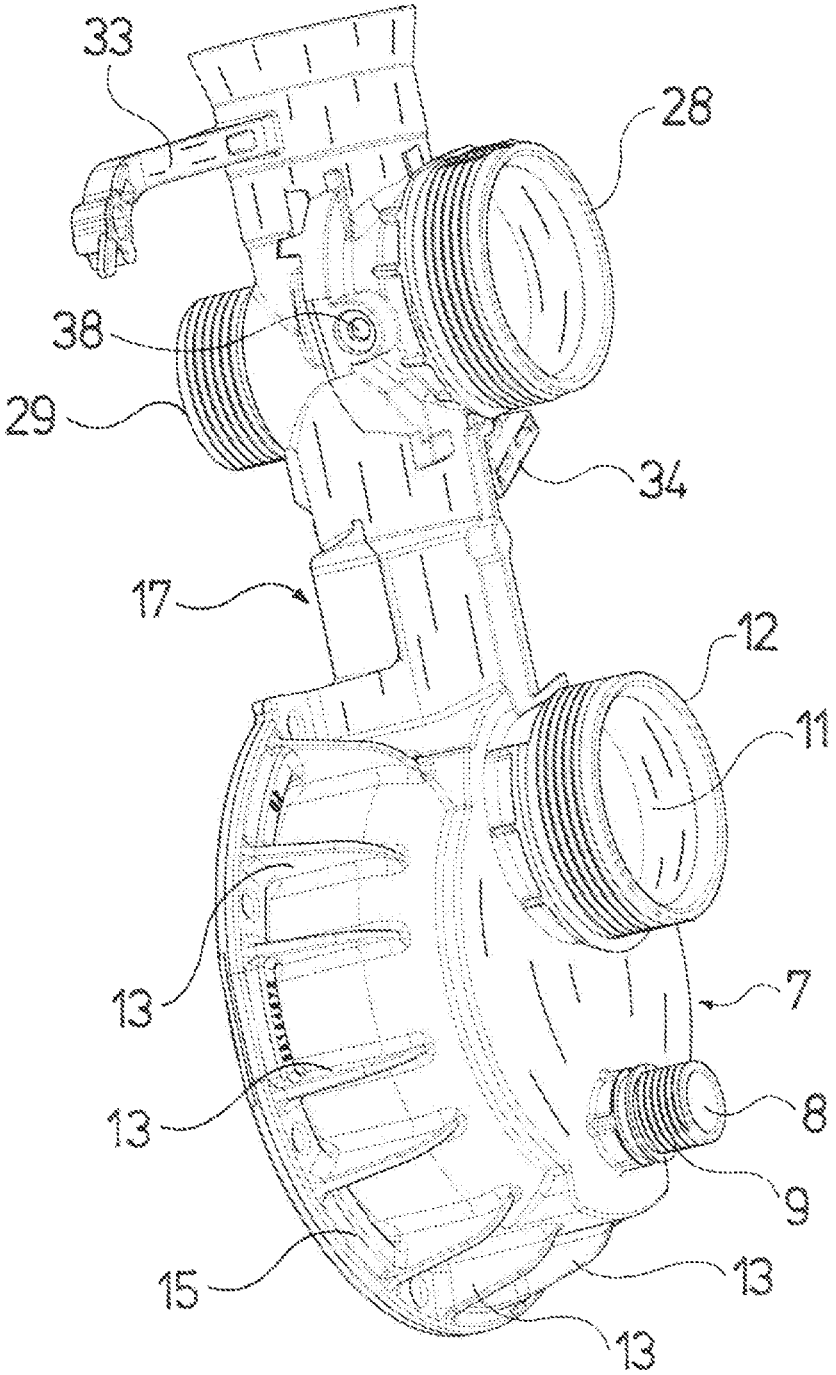
FIG. 4 is an enlarged perspective view of the construction unit according to FIG. 3, shown obliquely from below and the left at the front.
Figure 5:
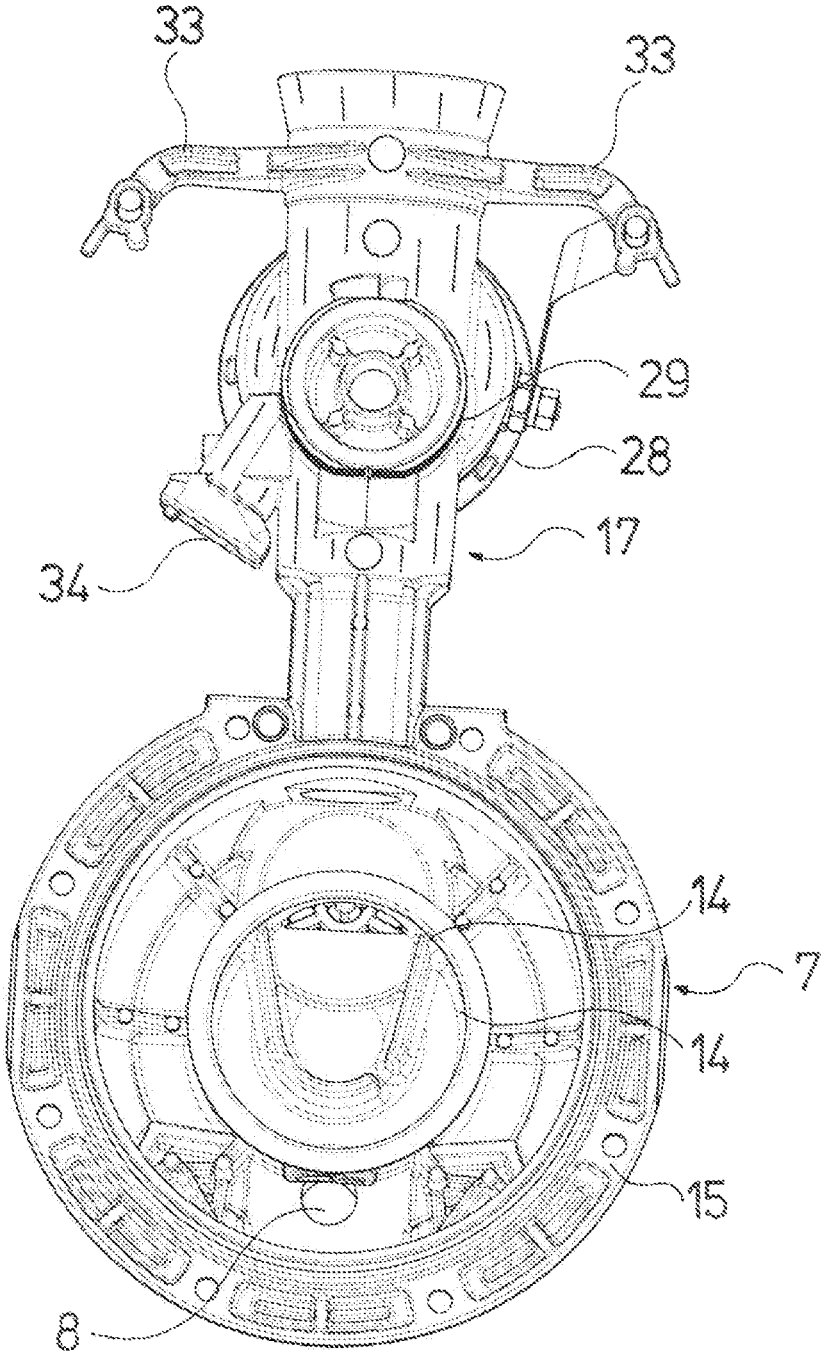
FIG. 5 is a perspective view showing the construction unit with the side directed inwards.

The casing 1 houses the water supply system essentially at five sides, according to FIG. 1 specifically at the bottom, at the top, at the face side which is on the right in FIG. 1, and at both sides which are not visible in FIG. 1, parallel to the plane of the paper. The casing 1 at the face side which is on the left in FIG. 1 is configured in an open manner and is closed off by a construction unit 6 which is formed by way of a single-piece plastic injection molded part which is represented by way of FIG. 3-5.

This construction unit 6 comprises a cap-like component 7 which is at the bottom in the installed position and which, to the lower side comprises an opening 8 which forms the water discharge opening of the water supply system. This opening 8 is provided with an outwardly projecting threaded connection piece 9, onto which a closure plug 10 can be sealingly screwed.

An opening 11 with a threaded connection piece 12 integrally formed to the outside and for the water inlet is provided at a distance above the opening 9.

The cap-like part 7 on its flat face side is provided with the connection pieces 9 and 12, but in the peripheral region is reinforced with ribs 13. This cap-like part 7 of the construction unit 6 to the inside forms a part of the pump casing and comprises the suction port 14 of the pump 3. This cap-like part 7 at the end of the ribs 13 comprises a flange-like, radial projection 15, via which a pump casing part 16 connecting inwardly thereon, surrounding the centrifugal pump 2 up to the drive-side end and through which the shaft 4 is led in a sealed manner, is screwed on.

A tubular part 17 connects radially at the top onto the cap-like part 7 and to the top is configured in an open manner and there is provided with an inner thread, in which a closure plug 18 is sealingly screwed. The closure plug 18 via a holder 19 which is arranged thereon carries a valve body 20 of a check valve 21, whose valve seat 22 is arranged in the tubular part 17.

The holder 19 consists of three rods which extend from the closure plug 18 in the direction of the valve seat 22 and which at the end side carry an annular body 23, in which the one end of the valve body 20 formed there in a rod like manner, is axially guided. The other end of the valve body 20 is led within the tubular part 17 by a guide cross 24. Thereby, a helical compression spring 25 which produces the closure force for the check valve 21 is arranged between the valve body 20 and the annular body 23. The valve body 20 in the region of the valve seat 22 is provided with a peripheral groove, in which an O-ring 26 providing the actual sealing is seated.

The arrangement of the closure plug 18, the holder 19, the valve body 20 and the valve seat 22 is configured such that the space directly behind the closure plug 18 is firstly connected to the pressure of the surroundings, on screwing on the closure plug 18. On screwing further out, the valve body 20 with the O-ring 26 is lifted from the valve seat 22, so that the space lying behind the check valve 21 is also connected to the pressure of the surroundings. The holder 19 with the valve body 20 and the O-ring 26 can be withdrawn out of this upwardly open opening of the tubular part 17 of the construction unit 6 in the manner of a cartridge, if the closure plug 18 is then completely rotated out.

Figure 2:
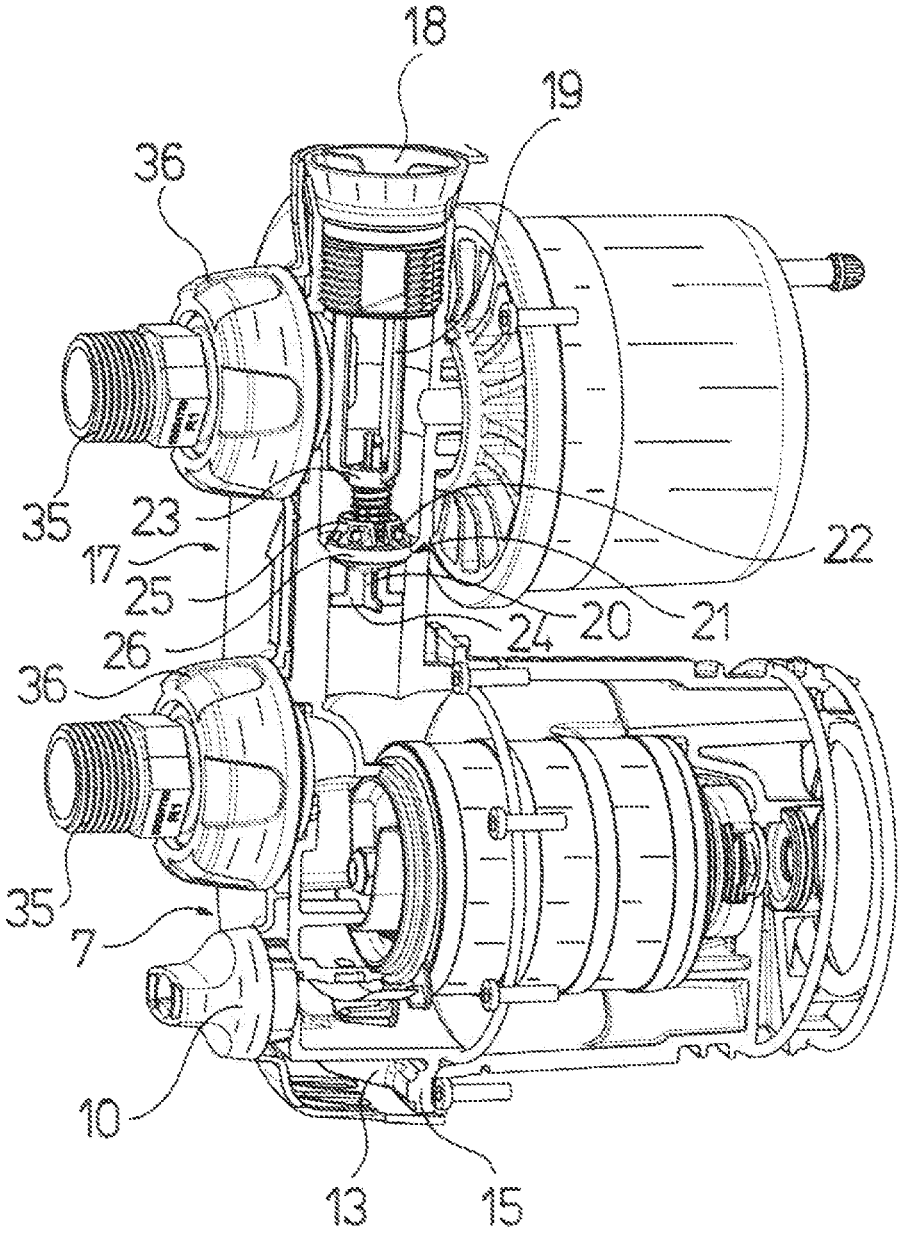
FIG. 2 is an enlarged perspective and partly sectioned representation of the construction unit with the parts connected thereto.

As is evident from FIGS. 1 and 2, the tubular part 17 runs out inwards within the pump casing, but into a region on the other side of the suction port 14, specifically in an annular channel 27 which extends from the delivery side of the pump 3 peripherally within the pump casing part 16. This tubular part 17 thus forms a pressure-side conduit of the centrifugal pump 3 and is provided with a threaded connection piece 28 for the water outlet, at a distance above the threaded connection piece 12 for the water inlet. This threaded connection piece 28 runs out in the channel which is formed by the tubular part 17, and specifically between the valve seat 22 of the check valve 21 and the closure plug 18. The threaded connection piece 28 for the water outlet thus in the operational position lies above the threaded connection piece 12 for the water inlet, is dimensioned and formed identically and is directed to the same face side which is at the left in FIG. 1.

A threaded connection piece 29 which is directed into the inside of the casing is provided on the rear side, thus directed inwardly, in a manner offset to the threaded connection piece 28 somewhat downwards, and is envisaged for the connection of a diaphragm tank 30 (also called compensation vessel 30) which can be screwed onto this threaded connection piece 29, so that the one part of the diaphragm tank 30 is connected to the pressure side of the water supply system. The other side in the usual manner comprises a closed gas volume 32 which is separated by the membrane 31 and which forms a pressure accumulator. The construction unit 6 apart from the threaded connection piece 29 comprises two support arms 33, since the diaphragm tank 30 with respect to the threaded connection piece 29 projects axially as well as radially, which is especially shown in FIGS. 1 and 2 and these support arms support the diaphragm tank 30 and at their ends are additionally fastened via screws. The diaphragm tank 30 is thus arranged above the centrifugal pump 3.

A further connection 34 which serves for the integration of a pressure sensor is provided on the tubular part 17, in the region between the threaded connection pieces 28 and 29. With regard to this connection 34, it is the case of such as is typically applied in compact heating installations, so-called gas heaters.

The threaded connection piece 28 for the water outlet and for the water inlet in each case receive a connection piece component 35 which is fastened by a union nut 36 which is screwed on the respective threaded connection piece 12, 28. This connection piece component 35, as is to be deduced from FIG. 1, is configured in a convex manner in the region, in which it is seated within the threaded connection piece 12, 28, and is provided with an O-ring for sealing, so that this connection piece component 35 can be pivoted a little, in order to be able to compensate alignment tolerances on connection of a conduit which is to be connected to the connection piece component 35 in each case.

Figure 6:
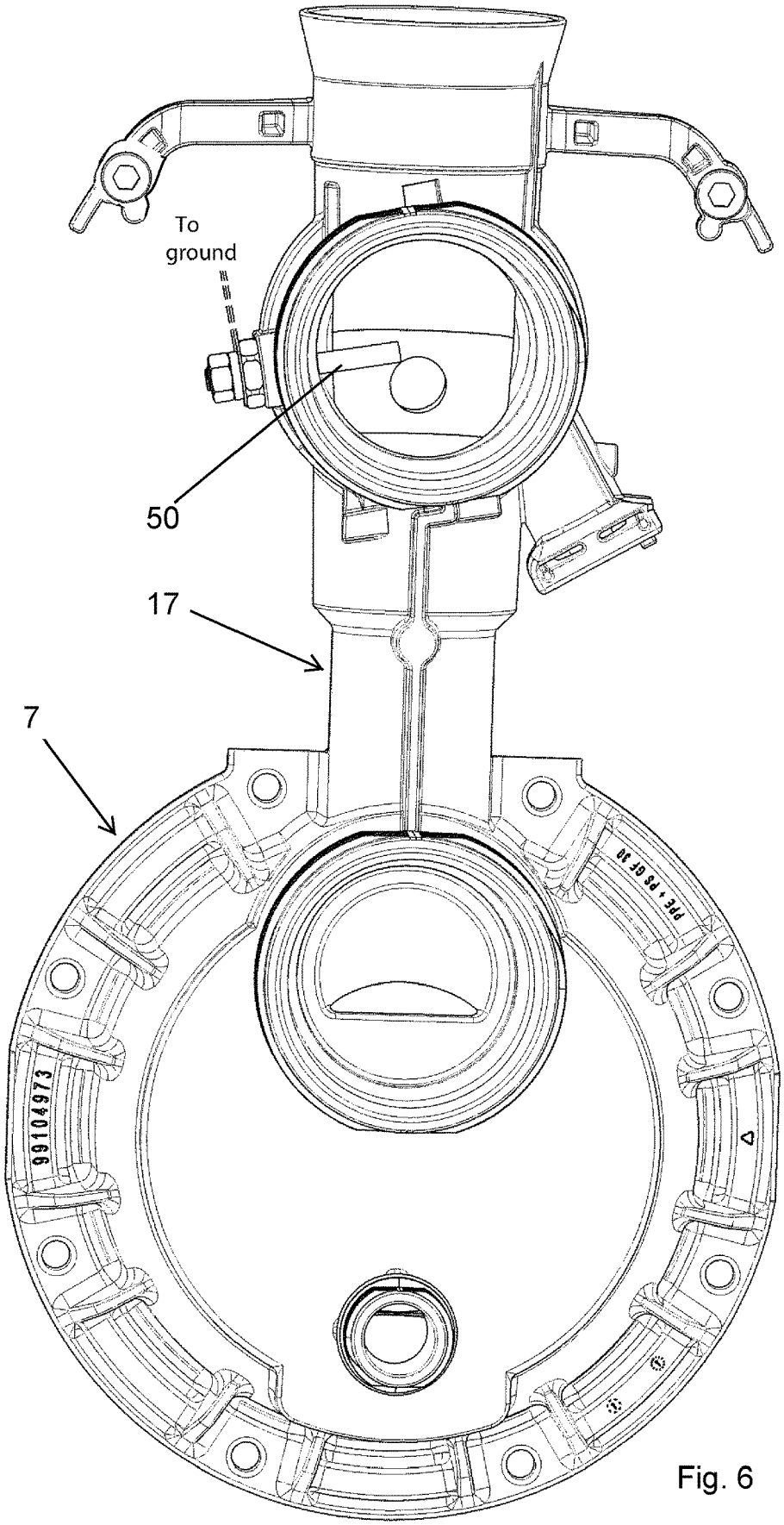
FIG. 6 is a front view of the construction unit with the side of the water connections.

An opening 38 for integrating a contact which is electrically connectively connected to an earth (ground) connection 50 which is led out through the casing 1 and is provided with a connection terminal at the outside is provided within the construction unit 6, in the fluid-leading region as shown in FIG. 6.

The electronics of the water supply system are accommodated in a separate electronics housing 37 which is arranged above the electric motor 5 and next to the diaphragm tank 30 and forms part of the casing 1.

With the water supply system described here, the fluid-leading components and the current-leading (live) components are not only arranged separately as is common, but also in separate parts of the casing 1, as the present description and in particular the sectioned representation according to FIG. 1 illustrates. With regard to design, this practically rules out fluid getting into the region of the electric motor and the electronics housing, even if leakages should occur in connection regions.

Not only are almost all fluid-leading conduits and connections integrated in the construction unit 6, but it also comprises the designs which are necessary for producing the self-priming effect. Thus the pump 3 lies below the threaded connection piece 12 for the water inlet, which ensures that a basic quantity of water always remains in the pump, even if no water is present at the water inlet. The closure plug 18 is to be removed, in order to fill this water on first starting separation of the water supply system or after the winter season, when the water has been drained, by which means the valve body 20 of the check valve 21 is simultaneously also removed, so that this channel which is otherwise secured against backflow by the valve 21 is opened, so that the water filled from the top can go downwards into the pump, wherein it then serves for enabling the self-priming effect, after the closure plug 18 has been inserted again and thus the check valve 21 also is effective.

While specific embodiments of the invention have been shown and described in detail to illustrate the application of the principles of the invention, it will be understood that the invention may be embodied otherwise without departing from such principles.

APPENDIX

List of Reference Numerals

1—casing
2—foot
3—centrifugal pump
4—shaft
5—electric motor
6—construction unit

7—cap-like part
8—opening (discharge opening)
9—threaded connection piece (discharge)
10—closure plug
11—opening
12—threaded connection piece (water inlet)
13—ribs of 7
14—suction port
15—flange-like projection of 7
16—pump casing part
17—tubular part of 6
18—closure plug
19—holder
20—valve body
21—check valve
22—valve seat
23—annular body
24—guide cross
25—helical compression spring
26—O-ring
27—annular channel
28—threaded connection piece (water outlet)
29—threaded connection piece (for diaphragm tank)
30—diaphragm tank/compensation vessel
31—membrane
32—gas volume
33—support arms
34—connection piece for the pressure sensor
35—connection piece components
36—union nuts
37—electronics housing
38—opening for contact

What is claimed is:

1. A water supply system comprising:

a centrifugal pump;

an electric motor with an electrical/electronic control; and a diaphragm tank, wherein the diaphragm tank is arranged above the centrifugal pump and are connected to one another via a construction unit which comprises a water inlet connection for supplying water to the water supply system, a water outlet connection to output water from the water supply system, a first fluid conduit connecting the water inlet connection and the centrifugal pump and a second fluid conduit connecting the water outlet connection and the pump, the first conduit being different from the second conduit, the water inlet connection defining an external water inlet connection of the water supply system, the water outlet connection defining an external water outlet connection of the water supply system, the centrifugal pump being located downstream of the water inlet connection and upstream of the water connection outlet with respect to a flow of fluid, the construction unit being configured as a single-piece plastic injection molded component.

2. A water supply system according to claim 1, wherein the construction unit further comprises part of a pump casing defining a suction port of the pump, the water inlet connection being located on one axial side of the construction unit with respect to a longitudinal axis of the construction unit and the suction port being located on another axial side of the construction unit with respect to the longitudinal axis of the construction unit.

3. A water supply system according to claim 1, wherein the construction unit further comprises a water discharge opening.

4. A water supply system according to claim 1, wherein the construction unit further comprises means for self-priming.

5. A water supply system according to claim 1, wherein the construction unit further comprises a check valve arranged in a conduit section between a pump casing part and the water outlet connection and/or a connection for the diaphragm tank.

6. A water supply system according to claim 5, wherein a conduit section for receiving the check valve connects radially onto the pump casing part and is configured open at an end side.

7. A water supply system according to claim 5, wherein the check valve is configured as an insertion cartridge, wherein a valve seat is formed in the conduit section.

8. A water supply system according to claim 1, wherein the water connections are arranged to one axial side of the construction unit in the direction of a centrifugal pump axis or parallel thereto, the water inlet connection facing in a water inlet connection direction away from the centrifugal pump, the water outlet connection facing in a water outlet connection direction, the water outlet connection direction being parallel to the water inlet connection direction.

9. A water supply system according to claim 1, wherein the water inlet connection and the water outlet connection are formed by threaded connection pieces, on which in each case a connection piece component is limitedly movably, and pivotably, and releasably fastened, the construction unit comprising a longitudinal axis, each of the water inlet connection and the water outlet connection extending in a radial direction with respect to the longitudinal axis.

10. A water supply system according to claim 1, wherein a connection for the diaphragm tank comprises a threaded connection piece as well as support means for fastening and/or supporting the tank, the diaphragm tank comprising a diaphragm tank longitudinal axis, the diaphragm tank longitudinal axis being non-parallel to a longitudinal axis of the construction unit.

11. A water supply system according to claim 1, wherein a connection piece for integrating an exchangeable pressure sensor cartridge is provided on a conduit section.

12. A water supply system according to claim 1, wherein the construction unit further comprises a ground connection which is accessible from an outside and which is arranged in the construction unit such that the ground connection is electrically in contact with a fluid being delivered.

13. A water supply system according to claim 1, wherein a pump casing part of the construction unit comprises a flange, via which the pump casing part is screw-fastened to a tubular pump casing part connecting thereto, wherein the construction unit closes an opening of the tubular pump casing part.

14. A water supply system according to claim 1, wherein the centrifugal pump and the electric motor comprise a common shaft and the electric/electronic control is arranged in an inner casing above the motor.

15. A water supply system comprising:

a centrifugal pump;

an electric motor with an electrical/electronic control;

a one-piece construction unit comprising a construction unit longitudinal axis; and a diaphragm tank, wherein the diaphragm tank is arranged above the centrifugal pump, the diaphragm tank being connected to the centrifugal pump via the one-piece construction unit, the one-piece construction unit comprising a connection for the diaphragm tank, a water inlet connection for supplying water to the water supply system, a water outlet connection to output water from the water supply system, a first fluid conduit connecting the water inlet connection and the pump and a second fluid conduit connecting the water outlet connection and the pump, the first fluid conduit being different from the second fluid conduit, the water inlet connection defining an external water inlet connection of the water supply system, the water outlet connection defining an external water outlet connection of the water supply system, the centrifugal pump being located downstream of the water inlet connection and upstream of the water connection outlet with respect to a flow of fluid, the water inlet connection and the water outlet connection being located on one axial side of the one-piece construction unit with respect to the construction unit longitudinal axis, the connection for the diaphragm tank being located on another axial side of the one-piece construction unit with respect to the construction unit longitudinal axis, the one axial side being located opposite the another axial side, the water outlet connection and the water inlet connection extending from the one-piece construction unit in a direction non-parallel to the construction unit longitudinal axis.

16. A water supply system according to claim 15, wherein the centrifugal pump, the diaphragm tank and the electric motor are arranged on the another axial side of the one-piece construction unit, the water inlet connection and the water outlet connection being parallel to a longitudinal axis of the diaphragm tank and a longitudinal axis of the centrifugal pump.

17. A water supply system according to claim 15, wherein the connection for the diaphragm tank comprises a threaded connection piece as well as support means for fastening and/or supporting the tank, the diaphragm tank comprising a diaphragm tank longitudinal axis, the diaphragm tank longitudinal axis being non-parallel to the construction unit.

18. A water supply system according to claim 15, further comprising:

a casing comprising a casing opening and a casing interior space, the one-piece construction unit closing the casing opening, the connection for the diaphragm tank, the centrifugal pump, the electric motor and the diaphragm tank being arranged in the casing interior space.

19. A water supply system comprising: a centrifugal pump; an electric motor with an electrical/electronic control; a one-piece construction unit comprising a first side and a second side, the first side being opposite the second side; and a diaphragm tank, wherein the diaphragm tank is arranged above the centrifugal pump, the diaphragm tank being connected to the centrifugal pump via the one-piece construction unit, the one-piece construction unit comprising a longitudinal axis, a connection for the diaphragm tank, a water inlet connection structure, a water outlet connection structure and conduit connections between the water inlet connection structure, the water outlet connection structure and the pump, the water inlet connection structure and the water outlet connection structure being located on the first side of the one-piece construction unit, the connection for the diaphragm tank being located on the second side of the one-piece construction unit, the water inlet connection structure being parallel to the water outlet connection structure, the water inlet structure comprising an external end surface, the external end surface being an external portion of the one-piece construction unit, the external end surface connection facing in a direction away from the centrifugal pump.

20. A water supply system according to claim 19, wherein the centrifugal pump, the diaphragm tank and the electric motor are arranged on the second side of the one-piece construction unit, the water outlet connection facing in a direction away from the centrifugal pump and the diaphragm tank, the water inlet connection facing in a direction away from the diaphragm tank.

* * * * *